United States Patent [19]

Masaki et al.

[11] 3,934,412

[45] Jan. 27, 1976

[54] THERMAL REACTOR FOR AFTERBURNING AUTOMOTIVE INTERNAL COMBUSTION ENGINE EXHAUST GASES

[75] Inventors: Kenji Masaki, Yokohama; Hatuo Nagaishi, Yokosuka, both of Japan

[73] Assignee: Nissan Motor Company Limited, Yokohama, Japan

[22] Filed: Aug. 8, 1974

[21] Appl. No.: 496,011

[30] Foreign Application Priority Data

Aug. 17, 1973 Japan ..... 48-92292

[52] U.S. Cl. ..... 60/288; 60/289; 60/299; 60/306; 23/288 FA

[51] Int. Cl.[2] ..... F01N 3/14; F02B 75/10

[58] Field of Search ..... 60/299, 288, 306, 289, 60/290, 301, 294; 23/288 FA

[56] References Cited

UNITED STATES PATENTS

| | | | |
|---|---|---|---|
| 3,180,712 | 4/1965 | Hamblin | 60/288 |
| 3,503,714 | 3/1970 | Lang | 60/288 |
| 3,826,089 | 7/1974 | Nakajima | 60/290 |
| R25,576 | 5/1964 | Cornelius | 60/301 |

FOREIGN PATENTS OR APPLICATIONS

| | | | |
|---|---|---|---|
| 631,368 | 6/1936 | Germany | 60/299 |
| 1,476,508 | 3/1970 | Germany | 60/287 |

*Primary Examiner*—Douglas Hart

[57] ABSTRACT

Reaction heat generated by oxidation in presence of an oxidation catalyst maintains a sufficient afterburning temperature during low engine load operation.

14 Claims, 4 Drawing Figures

THERMAL REACTOR FOR AFTERBURNING AUTOMOTIVE INTERNAL COMBUSTION ENGINE EXHAUST GASES

The present invention relates to a thermal reactor for purification of automotive exhaust gases containing noxious unburned components such as carbon monoxide and hydrocarbons before emission into the atmosphere.

In connection with a thermal reactor or an afterburner for reburning exhaust gases discharged from an automotive internal combustion engine, it is well known in the art for the interior of the thermal reactor to be heated by auxiliary heating means for rapidly reaching an appropriate reburning temperature of the exhaust gases when the interior temperature of the thermal reactor falls below a value too low to reburn the exhaust gases, as occurs during relatively low load engine operation. The auxiliary heating means generally includes additional fuel supply means such as a fuel injection device for supplying additional fuel under pressure into the interior of the thermal reactor and igniting means such as a spark plug for igniting the additional fuel injected through the additional fuel supply means.

However, with the thermal reactor having the auxiliary heating means of the type mentioned above a considerable amount of fuel, in the form of additional fuel, is consumed. Complicated construction and high heat resistance of the heating means are also required because the heating means must supply the additional fuel under pressure into the interior of the thermal reator under high temperature and pressure.

It is therefore a primary object of the present invention to provide an improved thermal reactor having therein heating means which does not require additional fuel and is simple in construction.

Another object of the present invention is to provide an improved thermal reactor having therein an oxidizing catalyst which generates reaction heat to heat the interior of the thermal reactor when exhaust gases containing unoxidized components are passed through it and are reburned with secondary air.

The nature and advantages of the thermal reactor according to the present invention will become more apparent from the following description taken in conjunction with the accompanying drawings in which like reference numerals and characters designate corresponding parts and units in some figures and in which.

Figure 1:
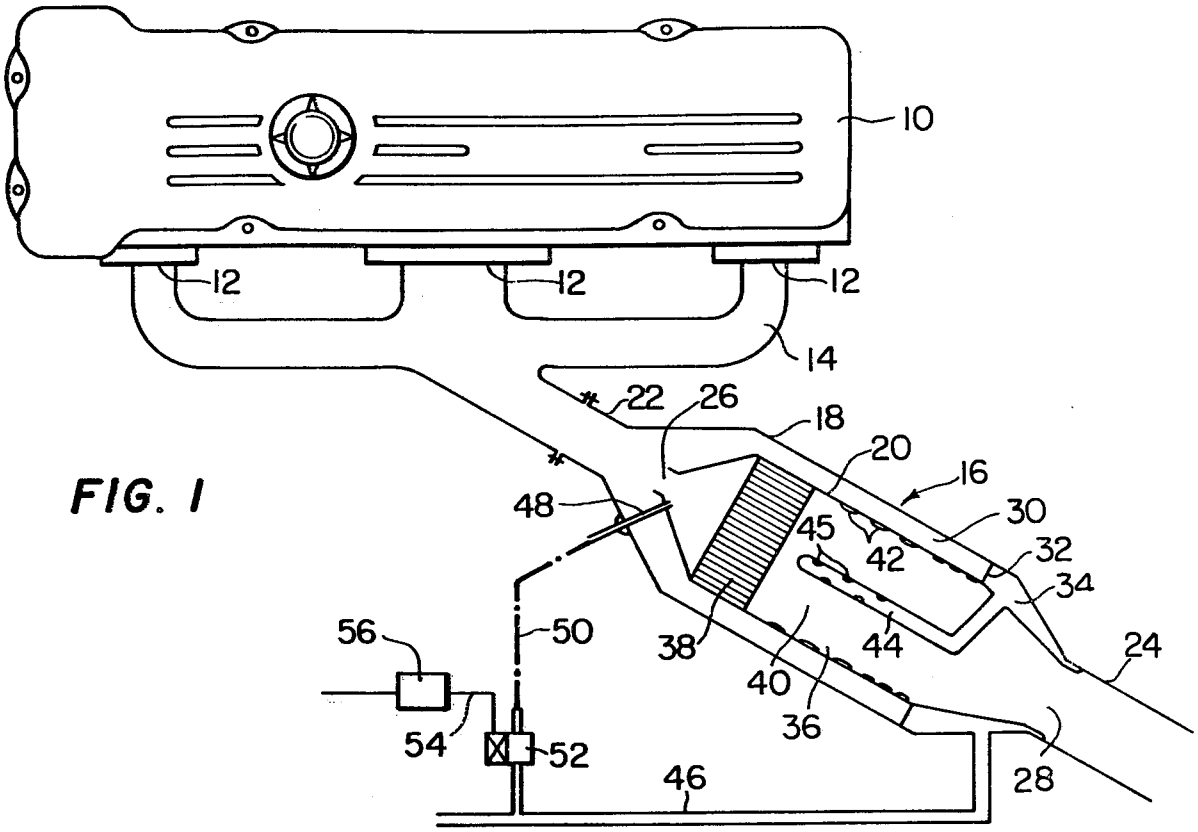
FIG. 1 is a schematic view of a preferred embodiment of a thermal reactor according to the present invention.

Referring now to FIG. 1, one preferred embodiment of a thermal reactor of the present invention is illustrated as used with a common automotive internal combustion engine 10 having a plurality of exhaust ports 12 to which an exhaust manifold 14 is connected. The exhaust manifold 14 is in turn connected to a thermal reactor 16 of the present invention.

The thermal reactor 16, often called an after-burner, includes an outer casing 18 and an inner casing 20, both being of generally cylindrical, elongate configuration. The outer casing 18 has an exhaust gas inlet 22 at the one end thereof and an exhaust outlet 24 at the other end thereof. The exhaust gas inlet 22 is connected to the exhaust manifold 14 through which the exhaust gases from the internal combustion engine 10 flow into the thermal reactor 16 to be purified therein.

The inner casing 20 has an inlet opening 26 at the one end thereof which opens in the direction of the exhaust gas inlet 22 of the outer casing 18 and an outlet opening 28 at the other end thereof which opens into the exhaust gas outlet 24. The outer periphery of the outlet opening 28 of the inner casing 20 is sealingly contacted with the inner periphery of the exhaust gas outlet 24 of the outer casing 18.

An outer chamber 30 is defined between the outer casing 18 and the inner casing 20. A partition wall 32 of annular shape defines a secondary air preheating chamber 34 at the downstream portion of the outer chamber 30. An inner chamber 36 is defined within the inner casing 20. At a portion upstream of the inner chamber 36, an oxidizing catalyst 38 is fixedly disposed. The catalyst 38 may be of monolithic type or honeycomb structure having a plurality of unobstructed openings. A catalytic component such as a platinum group metal is disposed on the surface of the structure. With the inner chamber 36, a reburning chamber 40 is defined between the oxidizing catalyst 38 and the outlet opening 28 of the inner casing 20. The reburning chamber 40 communicates with the outer chamber 30 through a plurality of perforations 42 formed in the inner casing 20.

A first secondary air injection nozzle 44 projects from the inner surface of the air heating chamber 34 into the reburning chamber 40 and extends along the longitudinal axis of the inner chamber 36 in the direction of the oxidation catalyst 38. The first injection nozzle 44 has a plurality of perforations 45 therein through which secondary air is injected into the reburning chamber 40. The first injection nozzle 44 communicates with the secondary air heating chamber 34 where secondary air is heated before injection. The heating chamber 34 in turn communicates with a secondary air source (not shown) such as an air pump through a secondary air conduit 46.

A second secondary air injection nozzle 48 is disposed in the inner chamber upstream of the oxidation catalyst 38 through the outer casing 18 and the inner casing 20. The second injection nozzle 48 is in turn connected through a secondary air pipe 50 to the secondary air conduit 46. In the secondary air pipe 50, a solenoid valve or a flow control valve 52 is disposed which is electrically connected through a line 54 to an engine load sensor or load responsive switch 56. The sensor or switch 56 is arranged in such a menner that the solenoid of valve 52 is energized for the valve 52 to close the secondary air pipe 50 when the engine load exceeds a predetermined level to prevent secondary air flowing therethrough. The engine load responsive switch 56 alternatively may be connected to a throttle valve (not shown) for energizing the solenoid valve 52 when the throttle valve opening degree exceeds a predetermined level.

In operation, the exhaust gases from the internal combustion engine 10 are admitted through the exhaust manifold 14 into the thermal reactor 16. When the temperature of the exhaust gases is relatively low, as during low load engine operation, the part of the exhaust gases admitted through the inlet opening 26 into the upstream portion of the inner chamber 36 is mixed with the secondary air injected from the second secondary air injection nozzle 48 since under these conditions the solenoid valve 52 is opened to allow the flow of secondary air. The mixture is thereafter passed through the oxidation catalyst 38 to oxidize unburned noxious components of the exhaust gases. In this step, carbon monoxide of the unburned noxious components is selectively oxidized to generate reaction heat. The oxidized high temperature gases are discharged from the oxidation catalyst 38 into the reburning chamber 40. The other part of exhaust gases admitted into the thermal reactor 16 is introduced into the outer chamber 30 and thereafter through the perforations 42 into the reburning chamber 40 causing a vortex flow. The exhaust gases containing unburned components are mixed with the oxidized high temperature gases from the catalyst 38 and are heated by same. The thus heated exhaust gases are further mixed with secondary air injected from the perforations 45 formed in the first secondary air injection nozzle 44 to burn the remaining unburned components such as carbon monoxide and hydrocarbons.

To effectively use the oxidizing catalyst 38, the temperature of the exhaust gases passing through it must be at least 400°C or at an activating temperature of the catalyst 38 and contain sufficient oxygen to allow catalytic oxidation. Thus in the thermal reactor of the invention, due to injection of secondary air into the exhaust gas flow upstream of the catalyst 38, burning occurs and increases the temperature of exhaust gases to a sufficiently high temperature to activate the catalyst 38. The activated catalyst then employs the remaining oxygen in further subsequent heat generating oxidation. Thus even if the temperature of exhaust gases discharged from the engine is not high enough to activate the catalyst 38, as occurs during low load engine operation, the catalyst 38 can be activated to perform its function. It is preferable that the proportion between the areas of the inlet opening 26 and the perforations 42 if 2:8 to 3:7 to introduce 20 to 30% by volume of the total exhaust gases through the inlet opening 26 into the catalyst 38 while 70 to 80% by volume of the same flows through the perforations 42 formed in the inner casing into the reburning chamber 40. This effects a satisfactory vortex flow of the exhaust gases within the reburning chamber 40 and therefore results in satisfactory reburning of the unburned components.

When the temperature of the exhaust gases is relatively high or during high load engine operation, the oxidation reaction within the catalyst 38 ceases due to a lack of reaction supporting oxygen, since the solenoid valve 52 is closed and secondary air is not therefore injected through the second injection nozzle 48. Accordingly, all of the exhaust gases from the engine 10 are reburned in the reburning chamber 40 only by being mixed with the secondary air injected through the first injection nozzle 44.

Figure 2:
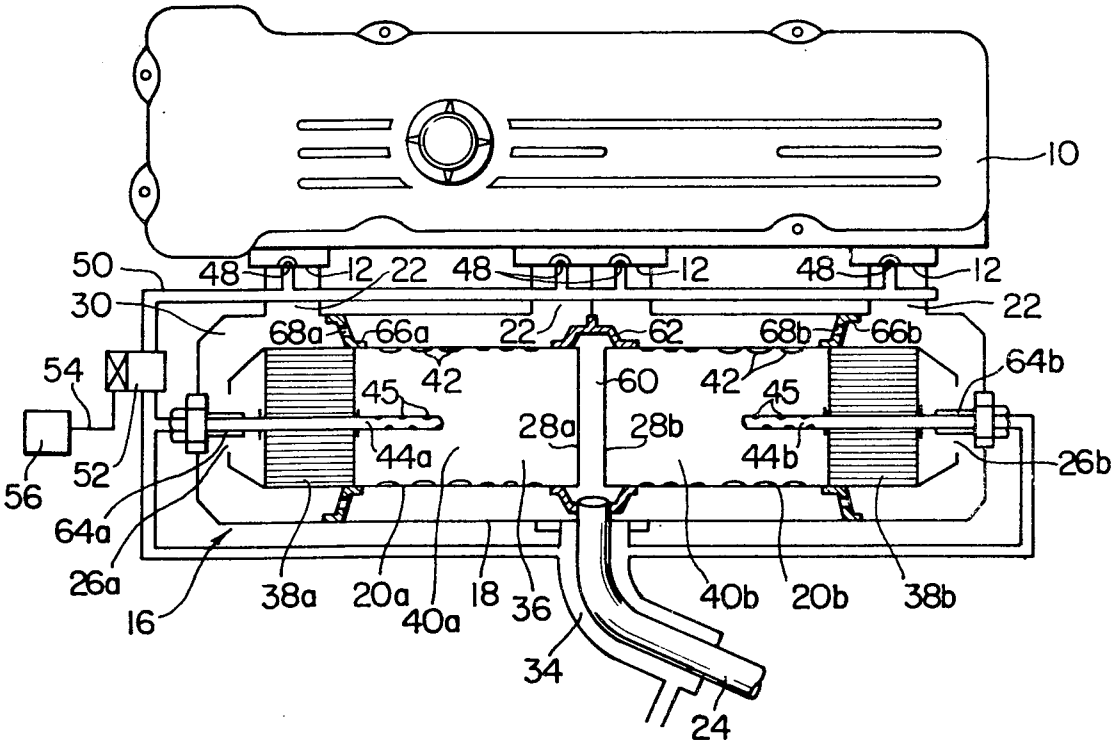
FIG. 2 is a schematic view of another preferred embodiment of a thermal reactor according to the present invention.

Another embodiment of FIG. 2 is similar to that shown in FIG. 1 with the exceptions that are as follows: An outer casing 18 of the thermal reactor 16 is directly connected through a plurality of exhaust gas inlets 22 to a plurality of corresponding exhaust ports 12 of an automotive internal combustion engine 10. To each exhaust ports 12, second secondary air injection nozzles 48 open. Within the outer casing 18, a first and a second inner casing **20*a* and 20*b* are symmetrically disposed and the inner casings 20*a* and 20*b* have a first and a second oxidation catalysts 38*a* and 38*b* respectively therein. The first and second inner casing 20*a* and 20*b* are combined at each outlet openings 28*a* and 28*b* with a space 60 formed between the outlet openings 28*a* and 28*b* by an annular connector 62 which has a U-shaped corss-section. An exhaust gas outlet 24 is connected through the outer casing 18 to the annular connector 62. Through the pair of catalysts 38*a* and 38*b*, a pair of first secondary air injection nozzles 44*a* and 44*b* extends symmetrically from the both ends of the outer casing 18 through each inlet openings 26*a* and 26*b* and the catalysts 38*a* and 38*b* into each reburning chambers 40*a* and 40*b* respectively. A pair of third secondary air injection nozzles 64*a* and 64*b* are disposed in the corresponding inlet openings 26*a* and 26*b* of the each inner casing 20*a* and 20*b*, and surrounding the first injection nozzles 44*a* and 44*b*** respectively.

In operation, when the temperature of the exhaust gases is relatively low or during low engine load operation, the exhaust gases from the engine 10 are premixed with secondary air injected through plurality of second secondary air injection nozzles 48 since a solenoid valve or a flow control valve 52 is opened to allow the flow of secondary air and are thereafter admitted into an outer chamber 30. A part of the exhaust gases is introduced through the inlet openings **26*a* and 26*b* into the each inner casing 20*a* and 20*b*. This part of the exhaust gases is then mixed with the secondary air injected through the third secondary air injection nozzles 64*a* and 64*b* and is thereafter introduced into the oxidizing catalysts 38*a* and 38*b*. Thus this part of the exhaust gases is heated as previously described, by combustion prior entry into the catalyst and by reaction in the catalyst 38*a* and 38*b*, and is then discharged into the reburning chambers 40*a* and 40*b*. While the other part of the exhaust gases is introduced from through openings 68*a* and 68*b* formed respectively in a pair of annular partition wall 66*a* and 66*b* through a plurality of perforations 42 formed in the inner casing 20*a* and 20*b* or directly through the perforations 42 into the reburning chamber 40*a* and 40*b*.**

In the reburning chamber **40*a* and 40*b*, the other part of the exhaust gases is heated by the oxidized gases from the catalyst 38*a* and 38*b* and is thereafter reburned by being mixed with the secondary air injected through the first secondary air injection nozzles 44*a* and 44*b*. The thus reburned and purified exhaust gases from the engine 10 are introduced through the each outlet openings 28*a* and 28*b* into the space 60 and are thereafter discharged through the exhaust gas outlet pipe 28 into the atmosphere. In this instance, all the secondary air injected through the first, second and third secondary injection nozzles is admitted from a secondary air source (not shown) through a secondary air heating chamber 34 surrounding the exhaust gas outlet 28.**

When the temperature of the exhaust gases is relatively high or during high load engine operation, the secondary air injection through the second injection nozzles 48 is stopped since the solenoid valve 52 is closed to block the secondary air flow through the secondary air pipe 50.

In this instance, the second injection nozzles 48 may disposed merely in the two exhaust ports in the extreme right and the extreme left. The reburning chambers 40*a* and 40*b* are always heated during engine operation since a suitable amount of the secondary air is always injected through the third injection nozzles 64*a* and 64*b* for oxidation reaction in the oxidizing catalysts 38*a* and 38*b*. The openings 68*a* and 68*b* formed respectively in the partition wall 66*a* and 66*b* are particularly effective in the engine having few combustion chambers for controlling the amount of exhaust gases into the catalyst 38*a* and 38*b*.

Figure 3:
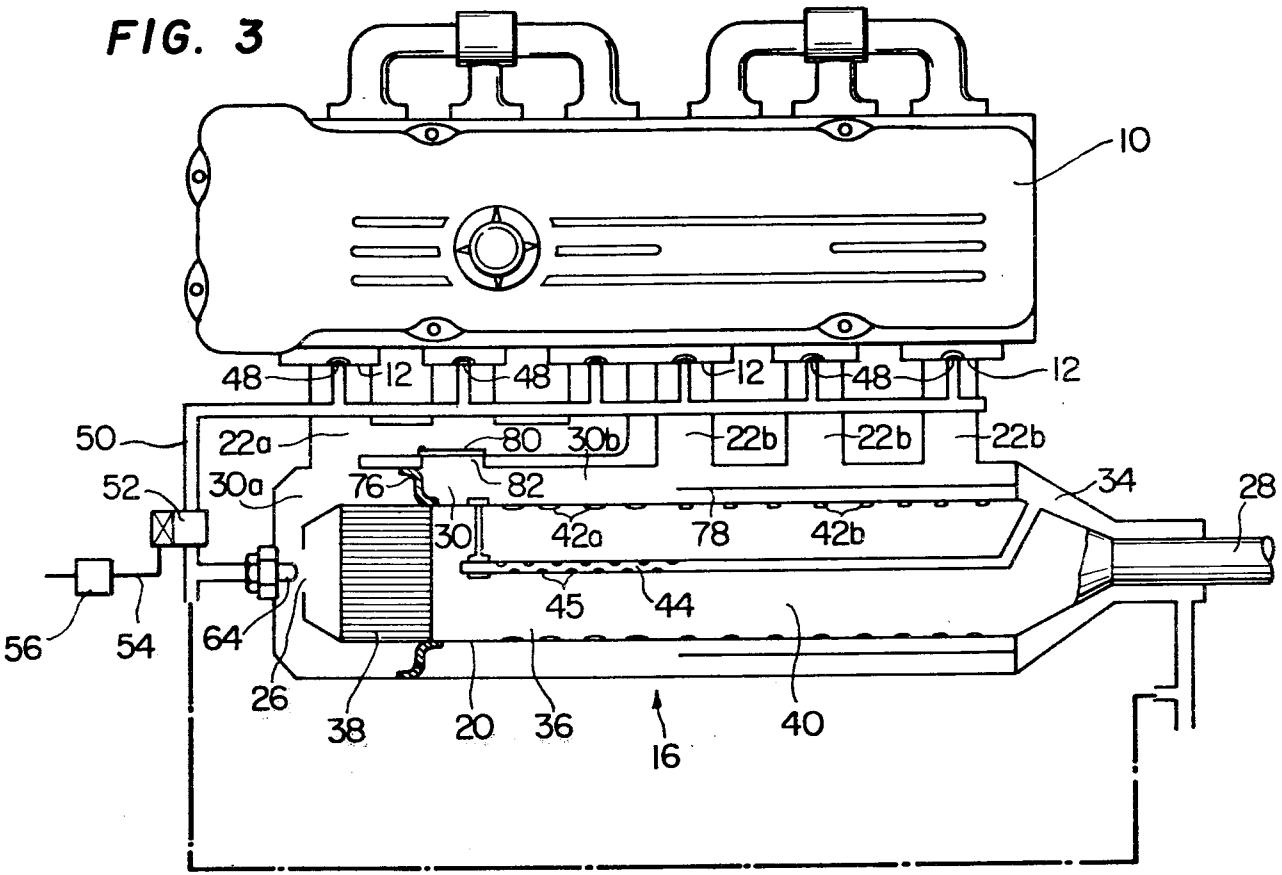
FIG. 3 is a schematic view of still another preferred embodiment of a thermal reactor according to the present invention.

FIG. 3 illustrates still another embodiment of the thermal reactor of the present invention which is so arranged as to introduce exhaust gases from the left three cylinders of the engine 10 through a first exhaust gas sub-inlet 22*a* into an oxidation catalyst 38 while the exhaust gases from the right three cylinders flow through at least one second exhaust gas sub-inlet 22*b* into a reburning chamber 40. Exhaust gas separation is accomplished by means of an annular partition wall 76 or a partition member disposed in an outer chamber 30. Thus the outer chamber 30 is divided into a first and a second outer sub-chambers 30*a* and 30*b*.

When the temperature of the exhaust gases is relatively low or during the low load engine operation, the exhaust gases from the left three cylinders of the engine 10 are admitted through the first exhaust gas inlet 22*a* into the first outer sub-chamber 30*a* of a thermal reactor 16 after being premixed with secondary air injected through the second secondary air injection nozzles 48. The exhaust gases are further premixed with the secondary air injected through the third secondary air injection nozzle 64 and introduced into the catalyst 38 to be oxidized. The exhaust gases are heated as previously described by pre-combustion and subsequent reaction in the catalyst 38 and thereafter discharged into the reburning chamber 40. While the greater part of the exhaust gases from the right three cylinders of the engine 10 are introduced from the second exhaust gas sub-inlets 22*b* through relatively large perforations 42*a* formed in the inner casing 20, the smaller part of the same gases passes through the relatively small perforations 42*b* after being directed by means of cylindrical deflector 78. The thus introduced exhaust gases are heated by being mixed with heated exhaust gases from the catalyst 38 and thereafter reburned by being mixed with secondary air injected through perforations 45 formed in a first secondary air injection nozzle 44 which communicates through a secondary air heating chamber 34 with a secondary air source (not shown).

When the temperature of the exhaust gases is relatively high or during high load engine operation, the secondary air injection through the second injection nozzles 48 is stopped since a solenoid valve or a flow control valve 52 is closed by an engine load sensor or load responsive switch 56 so as to block the secondary air flow through the secondary air pipe 50.

When the temperature of the exhaust gases rises and exceeds a predetermined level, a temperature responsive valve 80 such as a bimetal valve opens to by-pass the exhaust gases from the first exhaust gas sub-inlet 22*a* through a passage 82 to the second outer sub-chamber 30*b*. Accordingly, although the secondary air is always supplied through the third injection nozzle 64 into the catalyst 38, the reaction heat generated in the catalyst 38 is controlled and thermal damage of the catalyst 38 is therefore prevented.

In this instance, since the reburning chamber 40 is relatively long, satisfactory reburning of the exhaust gases is accomplished. In addition, since a relatively large amount of exhaust gases is introduced with the secondary air into the catalyst 38 during low load engine operation, the rapid heating of the thermal reactor 16 is accomplished.

Figure 4:
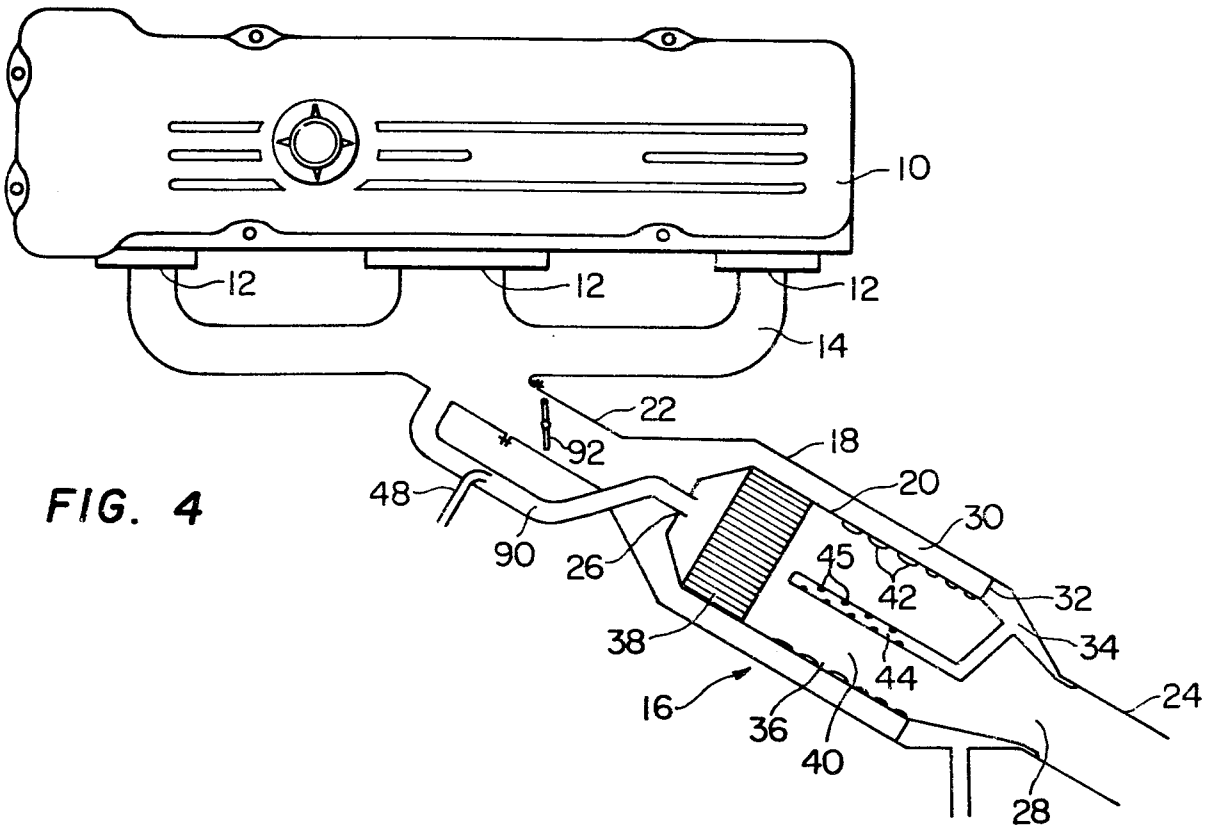
FIG. 4 is a shcematic view of a modification of the embodiment shown in FIG. 1.

FIG. 4 illustrates a modified example of the embodiment shown in FIG. 1, in which an inlet opening 26 of an inner casing 20 of a thermal reactor 16 is connected through a by-pass conduit 90 into which a second secondary air injection nozzle 48 opens. In addition, an exhaust control valve 92 is rotatably disposed in the exhaust gas inlet 22 of the thermal reactor 16. The control valve 92 may be mechanically connected to an acceleration pedal (not shown) and so arranged as to open substantially proportionally to engine load or depression of the acceleration pedal.

With the construction of the thermal reactor shown in FIG. 4, when the temperature of exhaust gases from an engine 10 is relatively low or during idling operation, almost all the exhaust gases from the engine 10 are introduced through the by-pass conduit 90 into the inlet opening 26 of the inner casing 20 since the exhaust gas control valve 92 is closed. In the by-pass conduit 90, the exhaust gases are premixed with the secondary air injected through the second injection nozzle 48. The exhaust gases are passed through an oxidation catalyst 38 for selectively oxidizing carbon monoxide there in and subsequent discharged into the reburning chamber 40. The other unburned components of the exhaust gases are burned by mixing with the secondary air injected through the first secondary air injection nozzle 44.

When the acceleration pedal is depressed and the temperature of the exhaust gases from the engine 10 is elevated, the exhaust gas control valve 92 is opened and the greater part of the exhaust gases from the engine 10 is introduced through the exhaust gas inlet 22 into outer chamber 30 of the thermal reactor 16. The exhaust gases are introduced through perforations 42 formed in the inner casing 20 into the reburning chamber 40. The smaller part of the exhaust gases from the engine 10 is introduced through the by-pass conduit 90 into the catalyst 38. The exhaust gases oxidized in the catalyst 38 are discharged into the reburning chamber 40 and mixed with the exhaust gases introduced through the perforations 42. The mixed exhaust gases are thereafter reburned by further mixing with the secondary air injected through the first secondary air injection nozzle 44. The thus burned and purified exhaust gases are discharged through the exhaust gas outlet 24 into the atmosphere.

In the instances shown in FIGS. 1 to 4, ignition means such as a spark plug (not shown) may be disposed in a portion of the inner chamber 36 downstream of the oxidizing catalyst 38 for igniting the exhaust gases during the initial step of the engine operation.

What is claimed is:

1. A thermal reactor for burning unburned components in exhaust gases of an internal combustion engine before emission to the atmosphere, the engine having a plurality of exhaust ports and the reactor including:

an outer casing having an exhaust gas inlet communicating with a plurality of exhaust ports;

an inner casing disposed within the outer casing and defining an outer chamber between the outer casing and the inner casing and an inner chamber therein, the inner casing having an inlet for the inner chamber to communicate with the outer chamber, an outlet communicating with the atmosphere, and a plurality of perforations formed therein to further communicate with the outer chamber; and characterized by an oxidation catalyst disposed in the inner chamber of said inner casing for promoting oxidation of the unburned components in the exhaust gases introduced through the inlet of the inner casing to generate oxidation reaction heat;

a first secondary air injection nozzle disposed in the inner chamber of the inner casing between said oxidation catalyst and the outlet of the inner casing; and a second secondary air injection nozzle disposed in a portion upstream of said oxidation catalyst for injecting secondary air into said oxidation catalyst.

2. A thermal reactor according to claim 1, further comprising a flow control valve connected to said second secondary air injection nozzle to block secondary air flow to said second secondary air injection nozzle when the engine load is sensed to exceed a predetermined level.

3. A thermal reactor according to claim 2, in which said flow control valve is a solenoid valve electrically connected to an engine load sensor, said solenoid valve closing to block said secondary air flow when energized by the sensor upon sensing the engine load exceeding the predetermined level.

4. A thermal reactor according to claim 1, in which the proportion between the areas of the inlet and the perforations of the inner casing is 2:8 to 3:7.

5. A thermal reactor according to claim 1, in which said second secondary air injection nozzle is disposed in the inner chamber in a portion upstream of said oxidizing catalyst.

6. A thermal reactor according to claim 1, further comprising a plurality of said second secondary air injection nozzles, one of which is disposed in each exhaust port.

7. A thermal reactor according to claim 6, further comprising a third secondary air injection nozzle disposed in the inlet of the inner chamber for supplying secondary air to said oxidizing catalyst.

8. A thermal reactor according to claim 7, further comprising a flow control valve connected to said second secondary air injection nozzles to block the secondary air flow from a secondary air source to said second secondary air injection nozzles when the engine load is sensed to exceed a predetermined level.

9. A thermal reactor according to claim 8, in which the outer chamber is divided into a first and a second outer sub-chamber by a partition member, the first outer sub-chamber communicating with a portion in the inner chamber upstream of said catalyst and the second outer sub-chamber communicating with a portion in the inner chamber downstream of said catalyst.

10. A thermal reactor according to claim 9, in which the exhaust gas inlet includes a first exhaust gas sub-inlet communicating said first outer sub-chamber with a part of exhaust ports, and at least one second exhaust gas sub-inlet communicating said second outer sub-chamber with the other part of exhaust ports respectively.

11. A thermal reactor according to claim 10, further including a temperature responsive valve to allow the exhaust gases introduced through the first exhaust gas sub-inlet to admit exhaust gases into the second outer sub-chamber when the temperature of the exhaust gases exceeds a predetermined level.

12. A thermal reactor according to claim 1, further comprising a by-pass conduit communicating the inlet opening of said inner casing with the exhaust ports of the engine, and an exhaust gas flow control valve disposed within the exhaust gas inlet for controlling the amount of the exhaust gases by-passing the exhaust gas inlet through said by-pass conduit in response to the engine load.

13. A thermal reactor according to claim 12, wherein said second secondary air injection nozzle is disposed in said by-pass conduit.

14. A thermal reactor according to claim 13, further comprising control means for opening said exhaust gas flow control valve substantially proportionally to the engine load.

* * * * *